US005992490A

United States Patent [19]

Kakita et al.

[11] Patent Number: 5,992,490

[45] Date of Patent: Nov. 30, 1999

[54] SIMPLE BINDING DEVICE

[75] Inventors: Toshimasa Kakita; Norihiko Murata, both of Tokyo, Japan

[73] Assignee: Nichiban Co., Ltd., Tokyo, Japan

[21] Appl. No.: 09/065,536

[22] Filed: Apr. 24, 1998

[30] Foreign Application Priority Data

Jul. 15, 1997 [JP] Japan ..... 9-189669
Nov. 27, 1997 [JP] Japan ..... 9-325802

[51] Int. Cl.[6] ..... B65B 11/56; B65B 67/08; B26F 3/02

[52] U.S. Cl. ..... 156/443; 156/459; 156/522; 53/587; 53/592; 225/77; 225/78

[58] Field of Search ..... 156/468, 475, 156/522, 577, 579; 53/139.1, 592; 100/2; 140/93.2; 29/33.5; 225/77, 78, 39, 65

[56] References Cited

U.S. PATENT DOCUMENTS

Re. 28,170 9/1974 Lehmann ..... 53/198
2,787,102 4/1957 Krueger ..... 53/198
2,963,208 12/1960 Yates et al. ..... 225/78
3,039,249 6/1962 Bouchard ..... 53/198
4,606,485 8/1986 Rankin ..... 53/76
4,816,109 3/1989 Ingram ..... 156/443
4,979,661 12/1990 Ho ..... 225/39
5,351,869 10/1994 Ridenour ..... 225/78

*Primary Examiner*—Richard Crispino
*Assistant Examiner*—Sue Purvis
*Attorney, Agent, or Firm*—Nath & Associates; Gary M. Nath; Gregory B. Kang

[57] ABSTRACT

Between the binding tape taking out section 7 and the tape cutting section 4 the tape reel 2 for keeping a wound tape 1 is disposed horizontally with each other. Thereby, the total length of the simple binding device is shortened to contribute to lower the total height of it, make it miniaturized and light-weighted and easier in mounting on a human body.

4 Claims, 11 Drawing Sheets

SIMPLE BINDING DEVICE

BACKGROUND OF THE INVENTION

1. Field of the invention

This invention relates to an improvement of a simple binding device.

2. Description of the prior art

As a harvesting work for vegetables and such, there are considered to be two cases which may be carried out by collecting and piling the vegetables on a truck, then binding those vegetables using a binding device put on a working table or binding the vegetables and such while harvesting instantly on the spot using a binding device held around the waist or the thigh. In the latter case, a simply structured and light weighted binding device is desired.

As one simple binding device as a prior art, for instance there is what is disclosed in a utility model publication No. Sho 64-4646. In explaining that based on FIG. 17, it comprises a tape reel 2 for holding a wound tape 1, a table 3 for use of putting articles to be bound W and a cutting section 4 for cutting the end of a binding tape 5 left over for binding, which are disposed in that order. And, in order to avoid the binding tape 5, which is taken out from the wound tape 1, from not being taken out in surplus or being loosened, the tape reel 2 is provided with a friction clutch 6 to give a braking force to the rotation of the tape reel 2 and give a certain resisting power to the taking out force of the binding tape 5.

Further, in the utility model publication No. Sho 58-54448 a tape holder is disclosed. In this tape holder, a tape reel is accommodated in a case having the depth approximately identical with the height (same to the width of a tape) corresponding to a wound tape in dimension, the tape is wound and kept around this tape reel, an inclined edge is provided at a tape taking out section, at which the tape taken out is twisted by 90 degree in such a manner as it becomes parallel with the case surface, and while guiding the twisted tape along a holding projection the tape is taken out by a necessary length and cut with a cutter blade.

In the conventional type of simple binding device as shown in FIG. 17, since the tape reel, the table for putting and the cutting section are disposed in that order, the whole length L of the simple binding device becomes long and the center of gravity is biased on the side of the tape reel due to the friction clutch mounted on the reel, sc that there is a problem to be improved that it is difficult to work for binding articles with the binding device being tied around the body.

Further, although, in the utility model publication No. Sho 58-54448, a technique is disclosed, in which a tape holder is provided with an inclined edge and a tape is taken out from a wound tape while being twisted by 90 degree on the inclined edge, this tape holder is just for taking out a tape and not provided with a function to bind articles to be bound.

The present invention is to provide a small binding device which is prepared as small-sized and light-weighted as possible, to make it easier to tie around -the body and handle it, further to improve it in the taking-out power of the binding tape by giving it an appropriate resistance during being taken out.

A means recognized from claim 1 for solving the above problem is characterized in that, in a binding device wherein a binding tape is taken out from a wound tape and a cutter cuts the remaining tape after binding an article, a tape reel for keeping a wound tape which is located between a binding tape taking-out section and the cutter of the cutting section is disposed horizontally with them mutually.

Next, a means recognized from claim 2 is characterized in that, in the binding device according to claim 1, the tape reel is located just below the binding tape taken out and supposed to be tensioned from the binding tape taking-out section to the cutting section so as to use it as a table for putting articles to be bound.

Further, a means recognized from claim 3 is characterized in that a table for putting an article to be bound is located just below the binding tape taken out and supposed to be tensioned from the binding tape taking-out section to the cutting section and the tape reel is disposed beside the table.

Further, a means recognized from claim 4 is characterized in that, in the tape taking-out section, guide rollers are provided so as to give a resistance to the binding tape being taken out.

Further, a means recognized from claim 5 is characterized in that an adhesion preventing plate is provided on an end of a base plate where the tape taking-out section is located by being spaced at a given distance from the tape taking-out section.

Further, a means recognized from claim 6 is characterized in that a hook is provided on the base plate removably.

Next, how to solve the above problems by the invention recognized in each claim is explained. First, in the invention recognized in claim 1, a tape reel for keeping a wound tape is disposed horizontally between a tape taking-out section and a cutting section, so that the total length of the simple binding device becomes short and the height becomes low.

Next, in the invention recognized in claim 2, in order to use as a table for putting an article to be bound the tape reel is disposed just below the binding tape taken from the tape taking-out section and the cutting section, so that it is not necessary to provide a separate table.

Next, in the invention recognized in claim 3, a table for putting articles to be bound is disposed just below the binding tape taken out from the tape taking-out section and to the cutting section, and beside the table the tape reel is located, so that regardless of the wound tape, the total length of the simple binding device becomes further short.

Next, in the invention recognized in claim 4, at the tape taking-out section guide rollers are provided for giving a resistance force to the binding tape, so that an excessive taking-out and loosening of the taking-out tape are prevented.

Next, in the invention recognized in claim 5, since an adhesion preventing plate is provided on an end of a base plate where the tape taking-out section is located by being spaced at a given distance from the tape taking-out section, the tape taken out on the tape-taking out section is prevented from being stick to the clothing of a worker during working.

Next, in the invention recognized in claim 6, by providing a hook on the base plate removably, the base plate is prevented from slipping off.

Now, in practicing manner of every invention recognized from every claim is explained. According to claim 1, as shown in FIG. 1, this is a simple binding device, in which a binding tape 5 is taken out from a taking-out section 7 of a wound tape 1 and, after binding an article put on a table 3 the binding tape 5 is cut at a cutting section 4, and a tape reel 2 for keeping the wound tape 1, which is located between the binding tape taking-out section 7 and the cutting section 4 is disposed horizontally.

Next, according to claim 2, as shown in FIG. 6, in order to use the tape reel 2 as a table for putting an article to be bound, it is disposed in such a manner as it is located just below the tape 5 taken out and supposed to be tensioned between the tape taking-out section 7 and the tape cutting section 4.

Next, according to claim 3, as shown in FIG. 2, just below the tape 5 taken out and supposed to be tensioned between the tape taking-out section 7 and the tape cutting section 4, a table 3 for putting an article to be bound is provided and a tape reel 2 is disposed beside the table 3. Next, according to claim 4, as shown in FIG. 1, at the tape taking-out section 7 guide rollers 8 and 9 are provided for giving a resistance to the taking out force.

Next, according to claim 5, as shown in FIG. 15, an adhesion preventing plate 26 is provided on an end of a base plate 14 where the tape taking-out section 11' is located by being spaced at a given distance from the tape taking-out section 11'.

Next, according to claim 6, as shown in FIG. 15, a hook 27 is provided on the base plate 14 removably.

BRIEF EXPLANATION OF THE ATTACHED DRAWINGS

Figure 4:
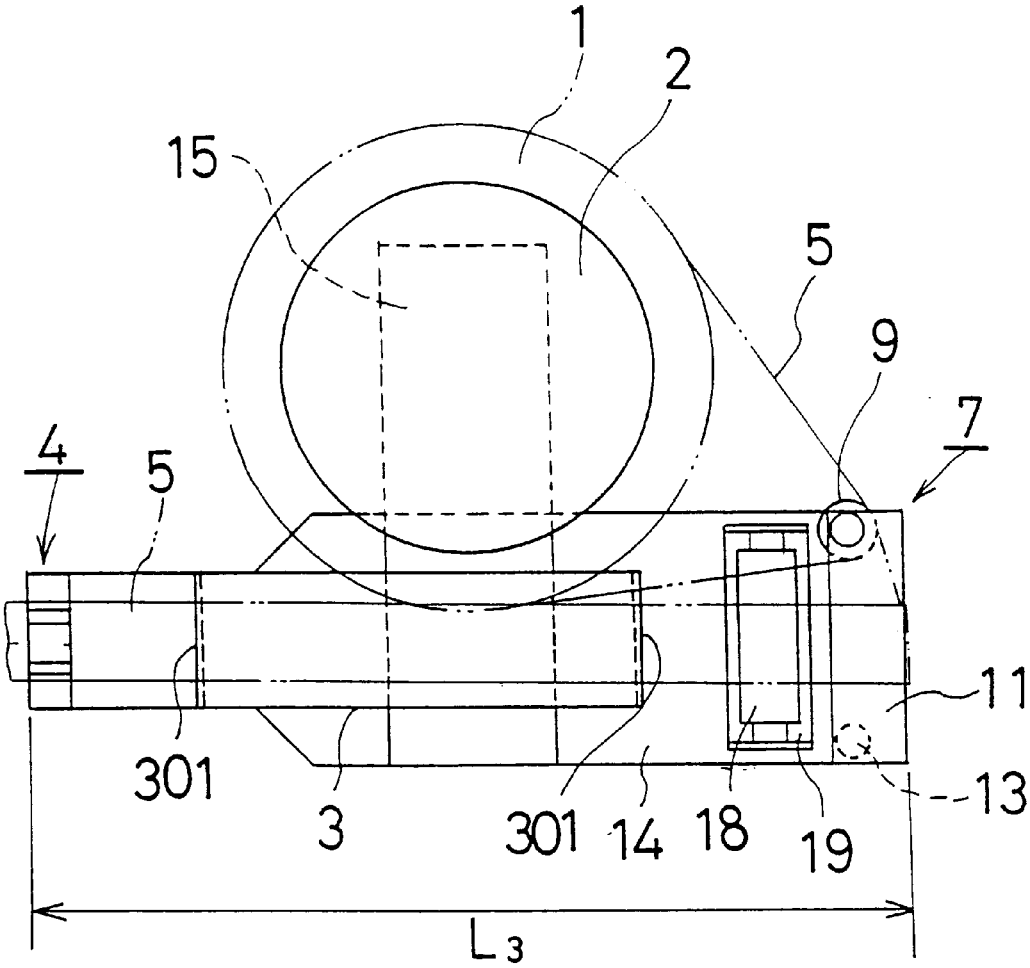
FIG. 4 is a plan view of another embodiment of the present invention.
Figure 10A:
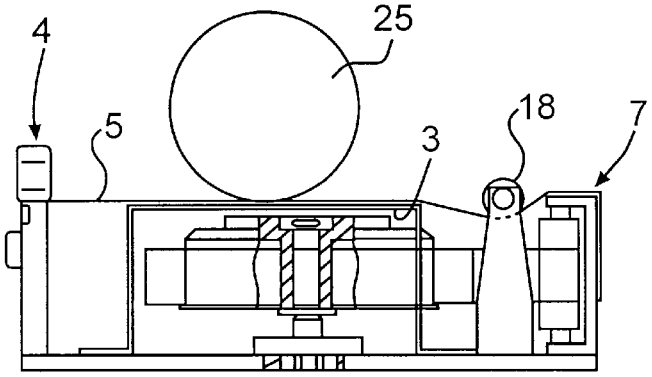

FIGS. 10*a, b* and *c* is to show a manner to bind an article to be bound using a simple binding device shown in FIG. 4.

Figure 6:
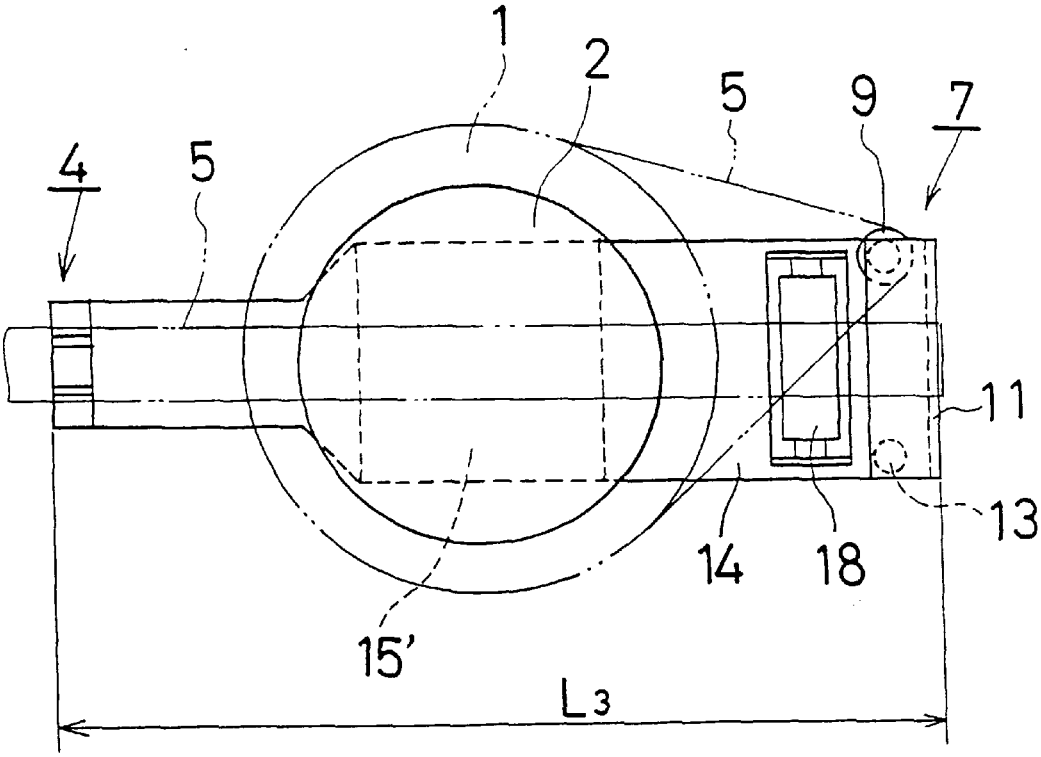
FIG. 6 is a plan view of still another embodiment of the present invention.
Figure 11:
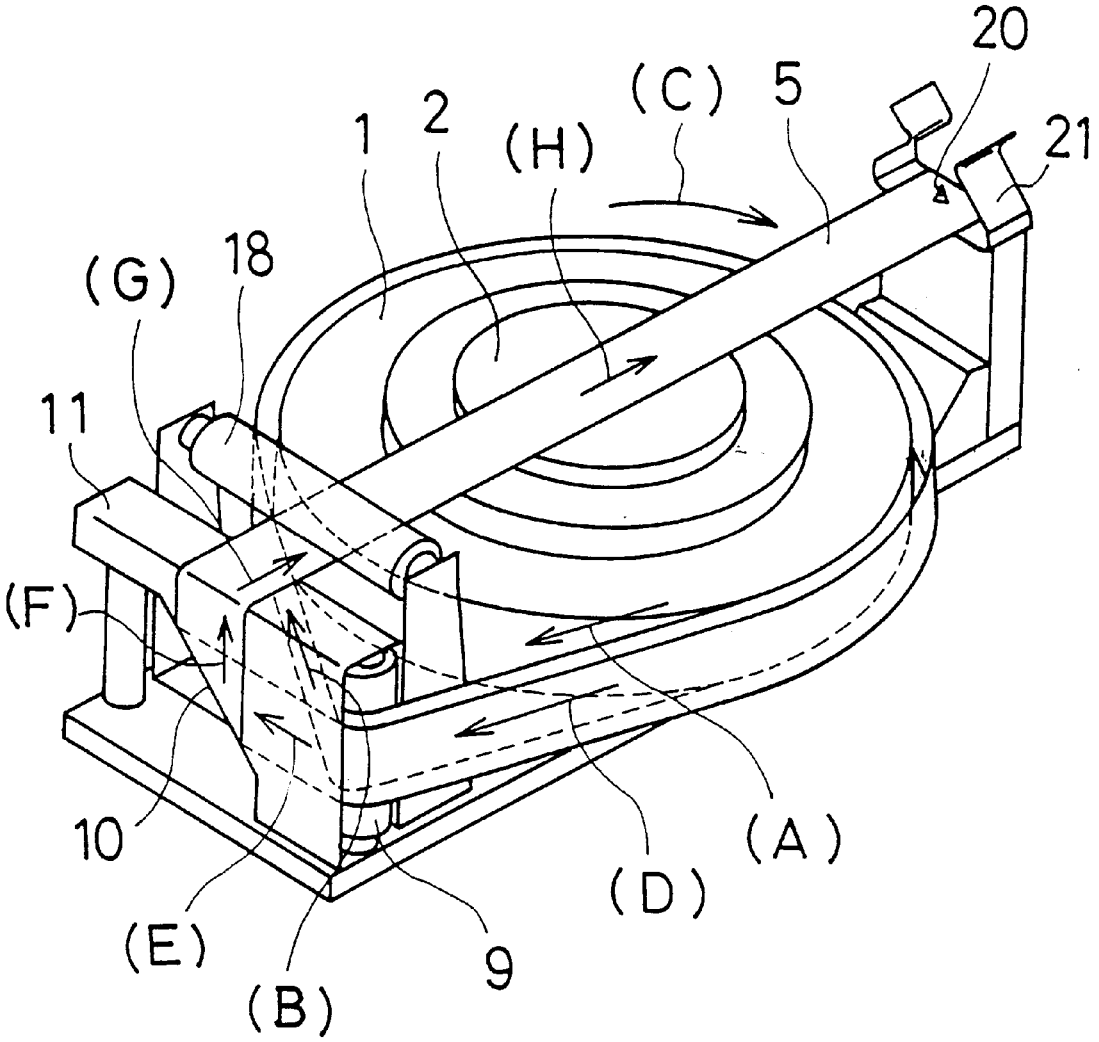

FIG. 11 is a perspective view showing how to take out the binding tape in the simple binding device shown in FIG. 6

Figure 12:
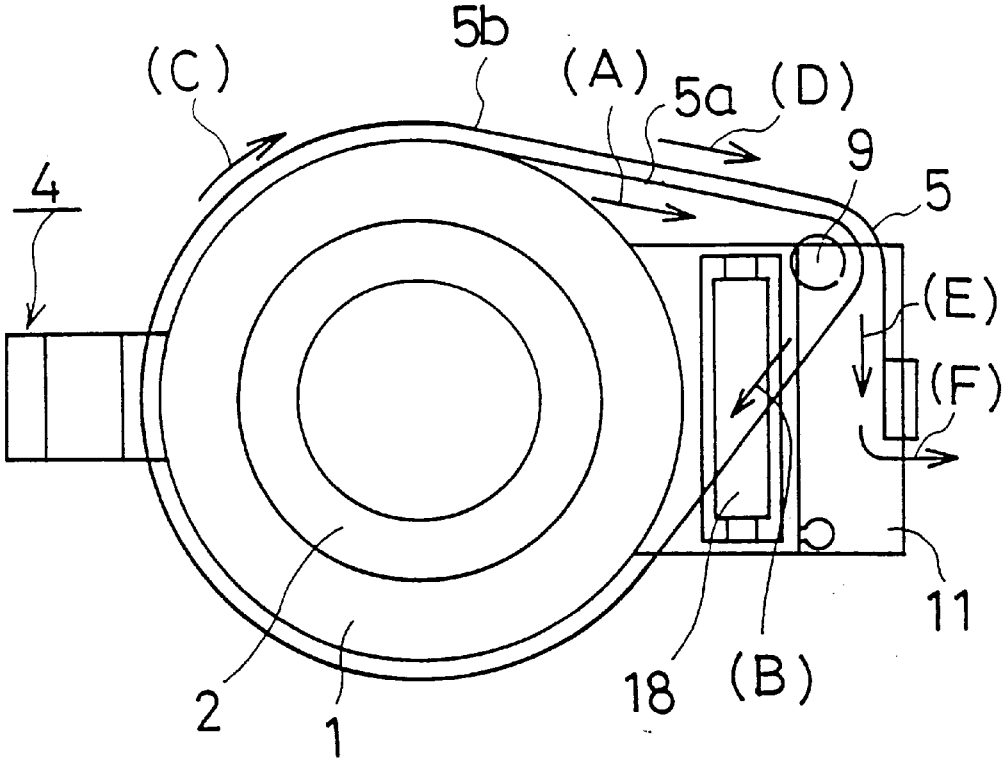

FIG. 12 is a plan view of FIG. 11.

Figure 13:
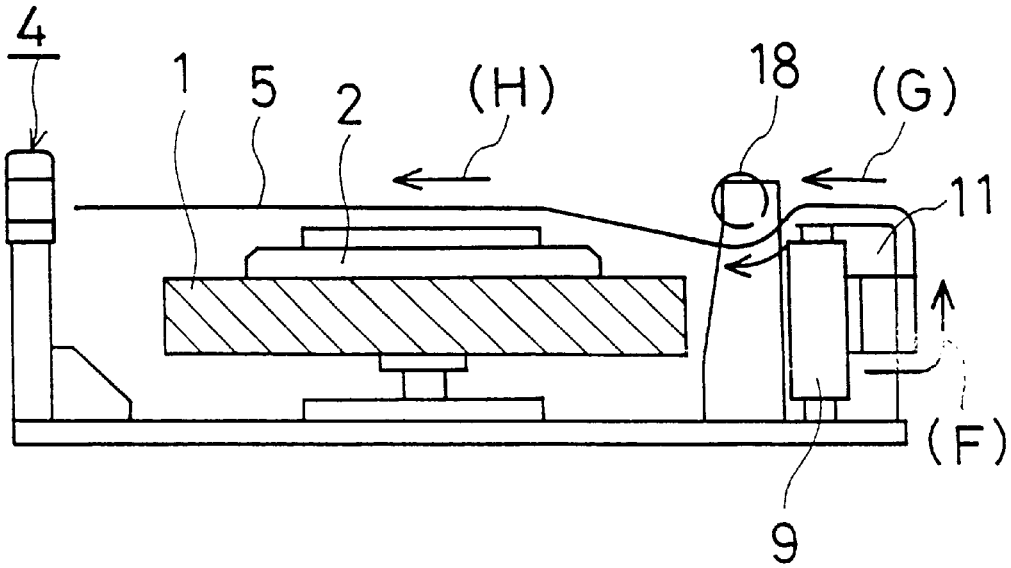

FIG. 13 is a front view of FIG. 12.

Figure 14:
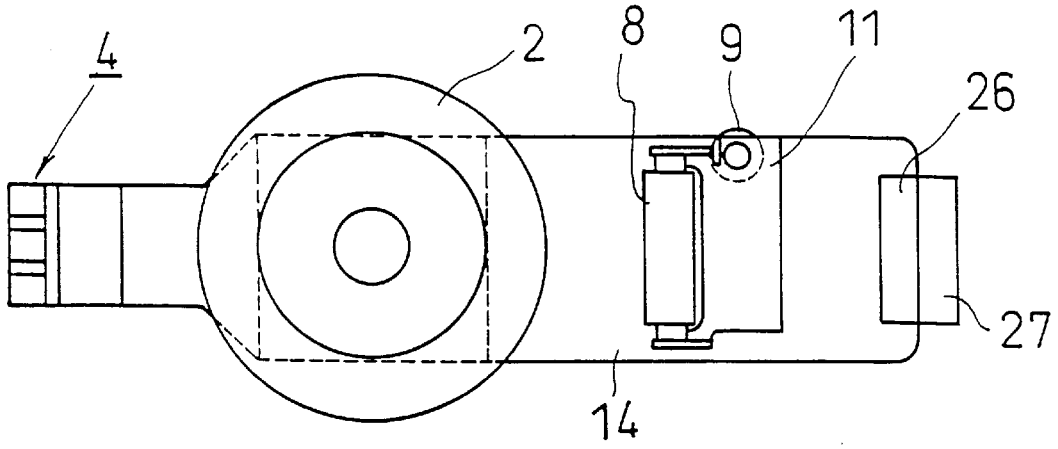

FIG. 14 is a plan view of still other embodiment of the present invention.

Figure 15:
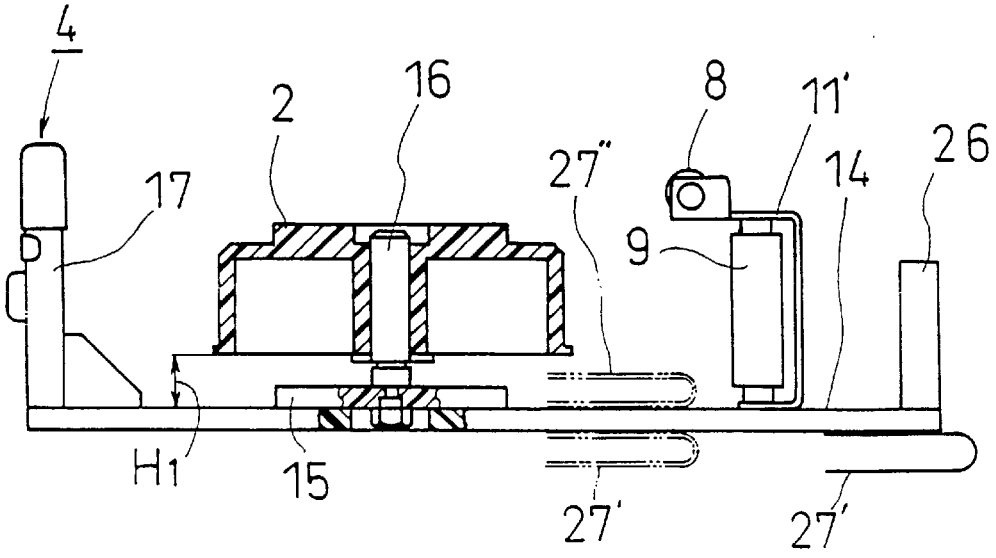

FIG. 15 is a side view of FIG. 14 partially in section vertically.

Figure 16:
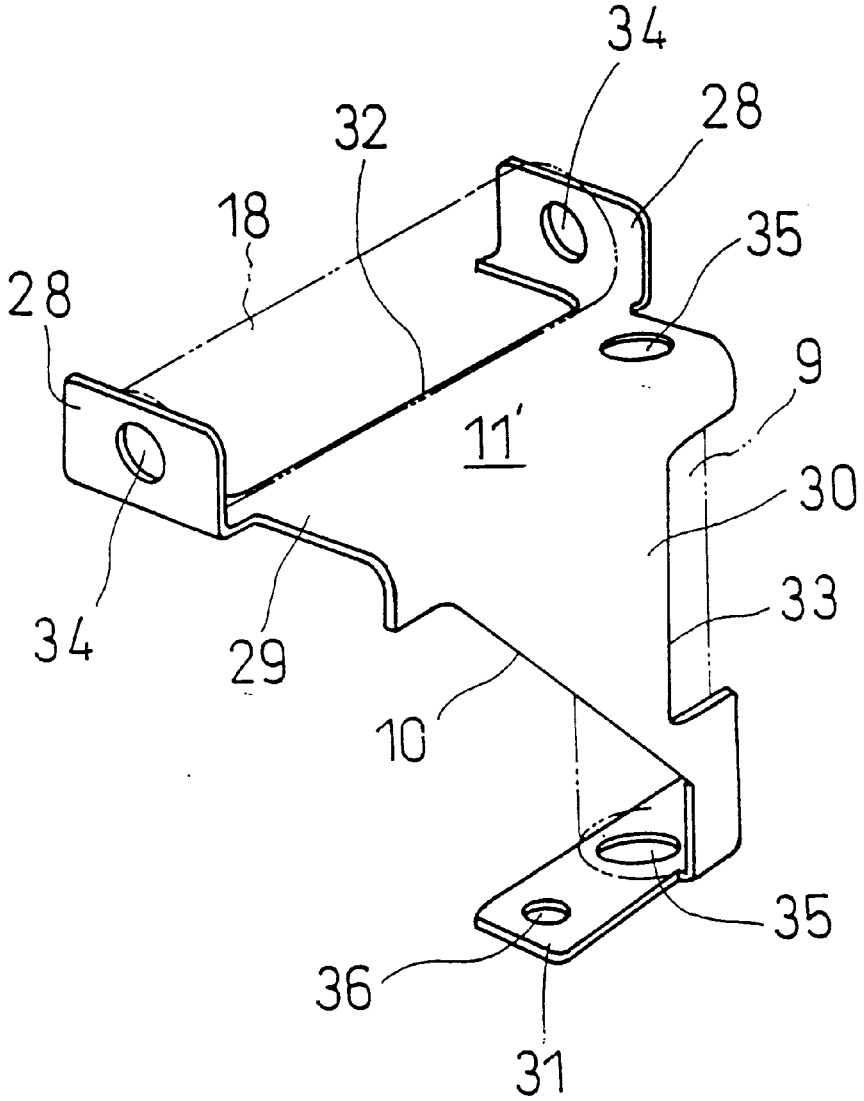

FIG. 16 is a perspective view of the tape taking-out section in FIG. 14.

Figure 17:
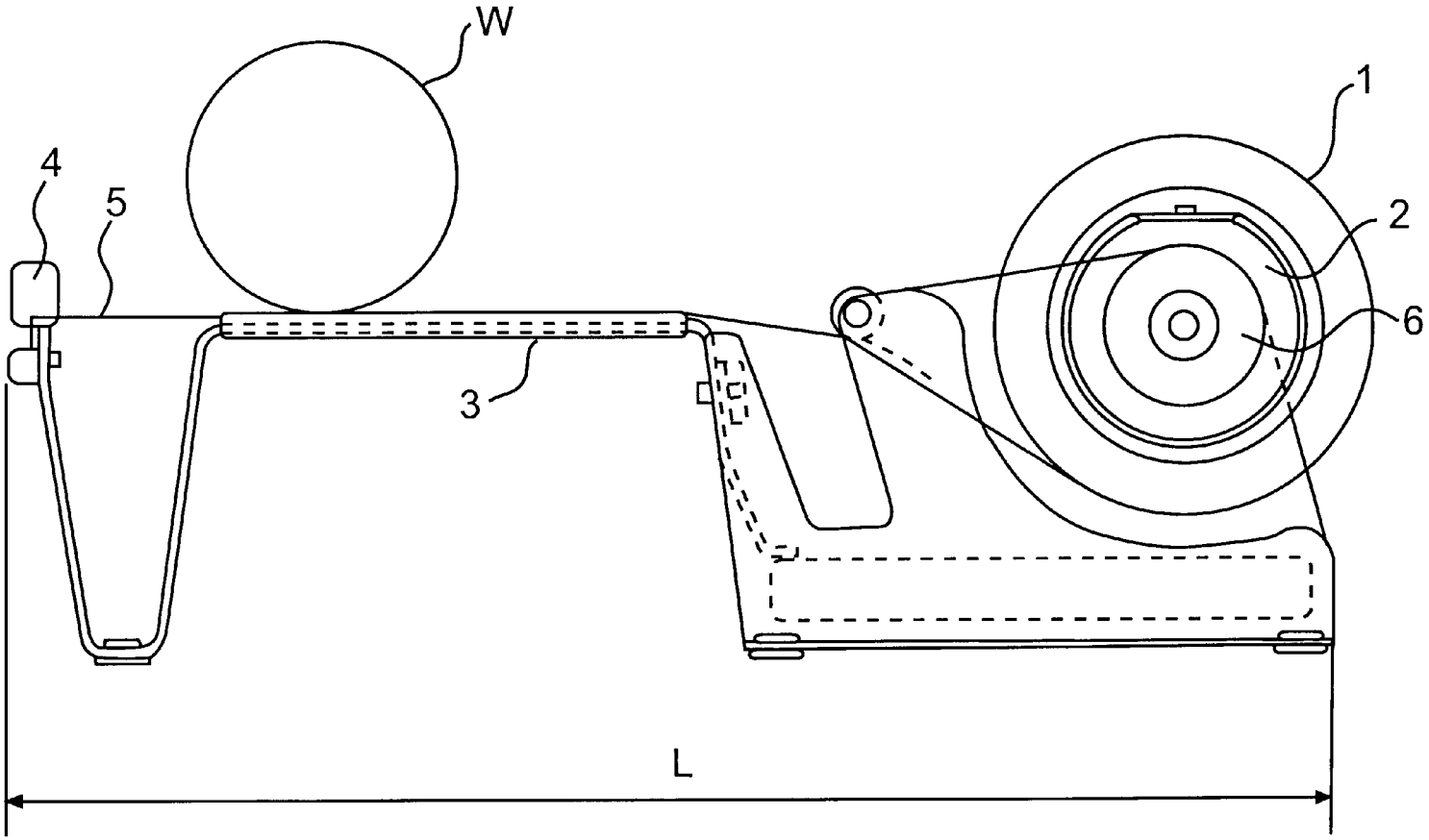
FIG. 17 (PRIOR ART)

FIG. 17 is a front view of a simple type of a conventional binding machine.

DETAILED EXPLANATION OF THE EMBODIMENT

Hereinafter, one embodiment of the present invention is explained in detail using FIG. 1 for showing the embodiment of the present invention. In this embodiment of simple binding device shown in FIG. 1, between a tape taking-out section 7 and a cutting section 4 a table 3 for putting an article to be bound is provided, beside of which a tape reel 2 for keeping a wound tape 1 is provided.

To a base plate 14 of this tape taking-out section 7 is fixed a tape taking-out guide member 11 which is formed with a direction change edge 10 having an inclined angle of 45 degree, on this tape taking-out guide member 11 is provided a guide roller 9 vertically. And, the binding tape 5 taken out from the wound tape 1 is changed in its taken out direction to a vertical direction by the direction change edge 10 of a leg portion of the table 3 through a tape guide bar 12, the guide rollers 8 and 9, hereinafter the tape is further folded to a horizontal direction by the tape taking-out guide member 11 and guided toward the cutting section 4. Thus, the binding tape 5 is changed in its taking-out direction at six sections of, in turn, the leg portion of the table 3, the tape guide bar 12, the guide roller 8, the guide roller 9, the direction change edge 10 and the tape taking-out guide member 11, and, since the leg portion of the table 3 and the tape guide bar 12 do not rotate, so that the binding tape 5 slides thereon to change its direction, when being taken out, a certain resistant force is adapted to be able to give the binding tape 5. FIG. 2 is a plan view of FIG. 1, as clearly shown, the guide roller 8 is disposed at the side of the tape reel 2 located between the tape taking-out section 11 and the table 3, and the tape guide bar 12 is disposed at the side spaced far from and opposite to the tape reel 2. And, the guide roller 8 and the guide roller 9 are separated by L1 in dimension to increase the winding surface to the guide rollers 8 and 9 of the taken out binding tape 5. Further, the guide roller 8 and the tape guide bar 12 are dispose on a same axis line C, however in this case another tape guide 12' may be disposed at a distance by L2 separated from the tape guide 12. And, the taking-out manner of the binding tape 5 may be changed depending on an adhesive force of the wound tape 1.

In detail, when the adhesive force of the wound tape 1 is strong, it is taken out like in the order of the leg portion 301 of the table 3, the tape guide bar 12 and the guide roller 8, and when the adhesive force is a little weak, it is taken out from the tape guide bar 12' to the guide roller 8, and when the adhesive force is still further weak, it is taken out from a supporting bar 13 to the guide roller 8. Thus, when the binding tape 5 is taken out from such as the tape guide bar 12, 12' and the supporting bar 13, the contacting area of the taken out binding tape 5 on the outer surface of the guide roller 8 becomes broader, then the binding tape 5 is taken out due to the rotation of the roller 8. And the dimension of the contact becomes broad in order from the tape guide bar 12 to the supporting bar 13, to that extent the binding tape taking-out force is increased as a resistance.

Figure 2:
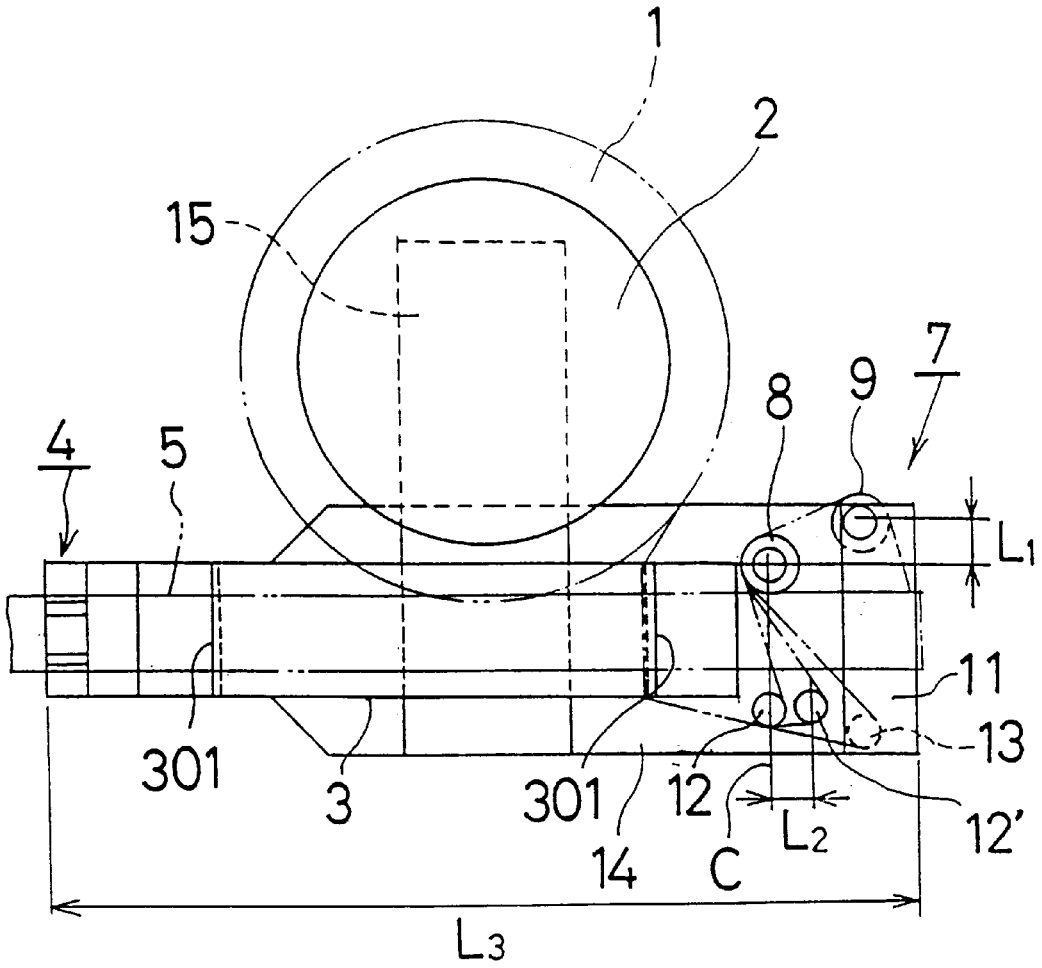
FIG. 2 is a plan view of FIG. 1.
Figure 3:
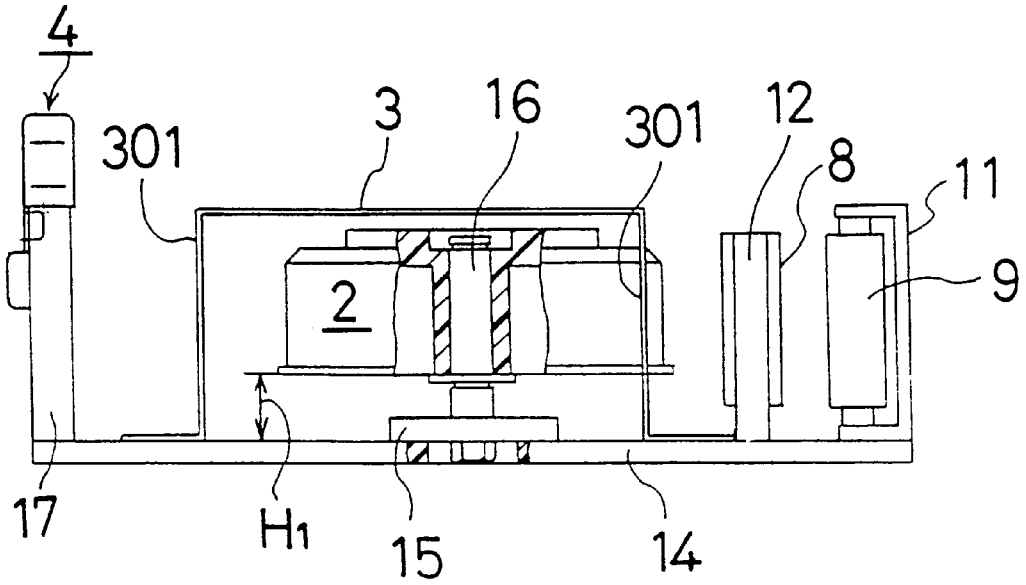
FIG. 3 is a front view of FIG. 2 partially in section vertically.

And, as shown in FIGS. 2 and 3, a tape reel supporting member 15 is fixed on the base plate 14 like projecting at the side of the base plate 14, to which the tape reel 2 is mounted rotatably with a mounting bolt 16. And, the mounting position of this tape reel supporting member 15 is located approximately at the center between the tape taking-out section 7 and the cutting section 4. And, as shown in FIG. 3, a gap having a height H1 is provided between the bottom surface of the tape reel 2 and a upper surface of the base plate 14, and further between a supporting pole 17 of the cutting section 4 and the leg portion 301 of the table 3 and between the leg portion 301 and the guide roller 8 also gaps are provided, and therebetween a belt is arbitrarily come through and the base plate 14 is adapted to be tied for instance around a thigh.

Figure 5:
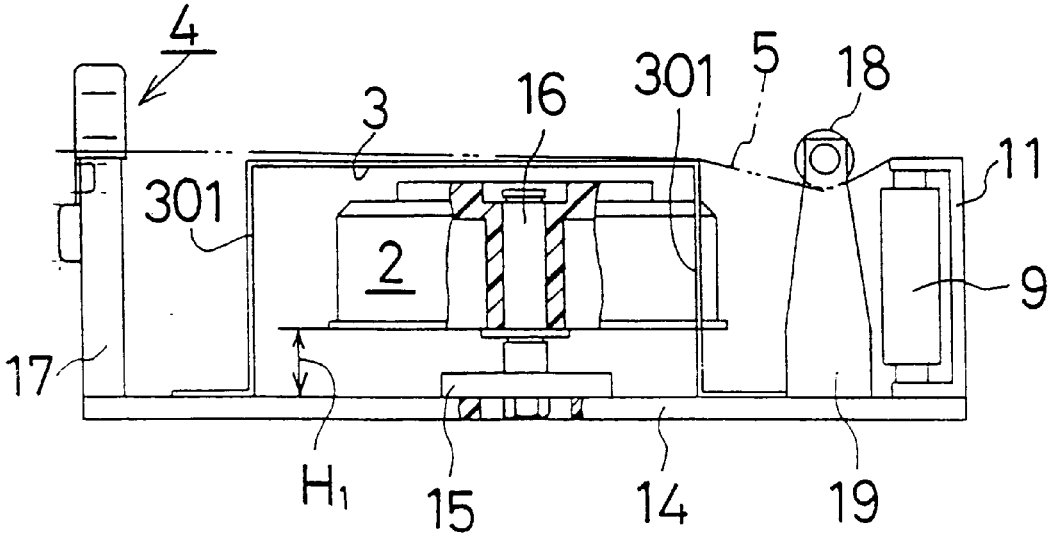
FIG. 5 is is a front view of FIG. 4 partially in section vertically.

In the embodiment shown in FIGS. 4 and 5, what is different from what is indicated in FIGS. 2 and 3 resides in that, in place of the guide roller 8 and the tape guide bar 12, a horizontal guide roller 18 is supported by a supporting member 19 and the adhesive surface of the taken out binding tape 5 is adapted to contact to the guide roller 18 to make the binding tape 5 along the table 3. Although how to take out the binding tape 5 is different, an explanation thereof is carried out later. Concerning the other portions, since they are indicated identically in FIGS. 2 and 3, an explanation thereof is omitted by using the identical signs on the same portions.

Figure 7:
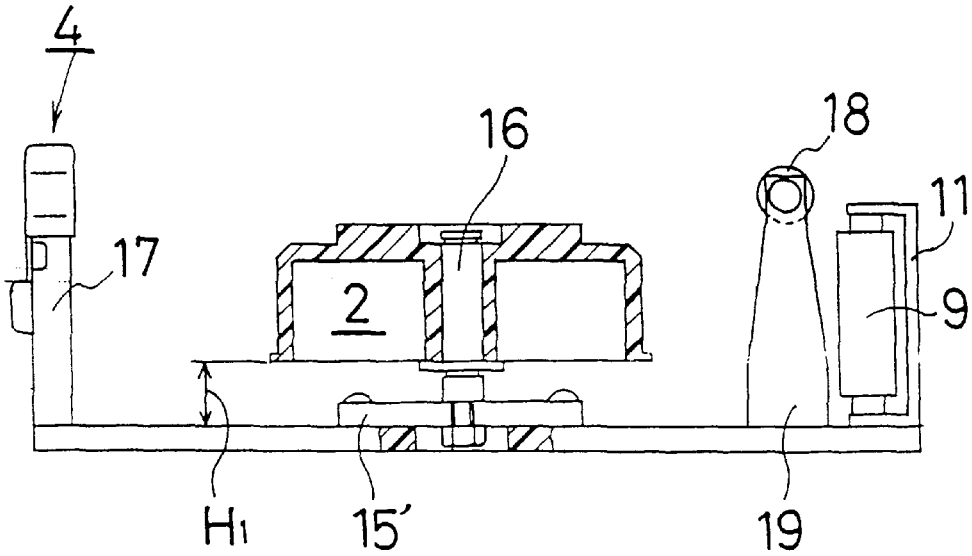
FIG. 7 is is a front view of FIG. 6 partially in section vertically.

In the embodiment of FIGS. 6 and 7, the tape reel 2 is disposed just below the binding tape 5 supposed to be tensioned from the tape taking-out section 7 to the cutting section 4 and approximately at the center between the tape taking-out section 7 and the cutting section 4 and this tape reel 2 itself is adapted to be used as a table for putting an article to be bound, and the table 3 indicated in FIGS. 2 and 4 is omitted. Further, a tape reel supporting member 15' forms approximately square without projecting from the base plate 14. Concerning the other portions, since they are indicated identically in FIGS. 2 and 4, an explanation thereof is omitted by using the identical signs on the same portions.

Figure 8:
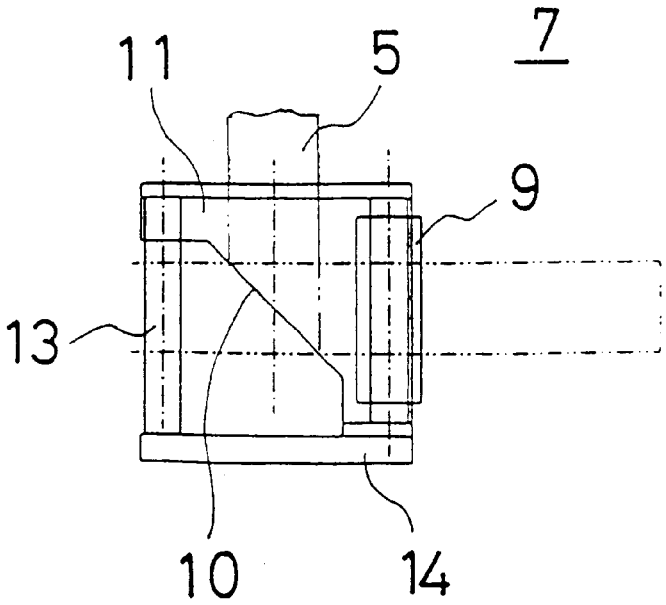
FIG. 8 is a side view of the tape taking-out section in FIGS. 1–7.
Figure 9:
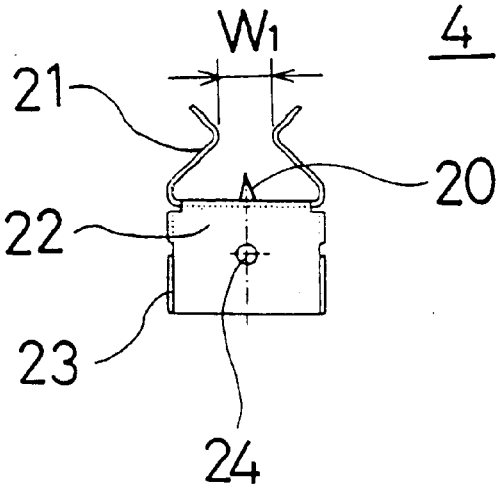
FIG. 9 is a side view of the cutting section in FIGS. 1–7.

Next, in FIGS. 8, 16 and 9, the tape taking-out section 7 and the cutting section 4 disclosed identically with what is disclosed in FIGS. 2, 4 and 6 are shown. First, at the portion of the tape taking-out section 7 shown in FIG. 8 the tape taking-out guide member 11 is provided, in which a direction changing edge 10 having an inclined angle of 45 degree is formed and this tape taking-out guide member 11 is fixed to the base plate 14 with the guide roller 9 and the supporting bar 13 in a unit.

Further, the supporting part 11' shown in FIG. 16 can omit the supporting bar 13 shown in FIG. 8 and the supporting member 19 of FIG. 5, and by the supporting part 11' a horizontal guide roller 18 is adapted to be supported. In more detail, a flange 31 is formed by bending the lower end portion of a vertical portion 30 and the upper end portion thereof by bending approximately at right angle a guide portion 29 is formed. And, the vertical portion 30 is provided with the direction changing edge 10 having an inclined angle of 45 degree, further so as to expose one portion of the guide roller 9, a recessed portion 33 is provided. Thus, by the provision of the recessed portion 33, as shown in FIG. 12, to set the tape 5 along the guide roller 9 is adapted to make easy.

On both sides of a tape guide portion 29, a guide roller support portion 28 is provided vertically, a guide roller support recessed portion 32 is provided so as to avoid the tape horizontal guide roller 18 from being interfered with tape guide portion 29. A sign 34 designates a support hole for supporting the horizontal guide roller 18, a sign 35 designates a hole for supporting the guide roller 9, a sign 36 designates a bolt hole for fixing the flange 31 to the base plate 14, in which the guide roller 9 is fixed to the tape taking out guide member 11' through the support hole 35 pierced the flange 31 and the flange 31 is fixed to the base plate 14. Thus formed, the supporting bar 13 indicated in FIG. 8 is omitted and the supporting member 19 indicated in FIG. 5 is also omitted, so that, due to reduction of the number of parts, mounting (or assembling)is improved, which causes the binding device to reduce its weight and to be handled easily. And, by taking out the binding tape 5 along the guide roller 9 through the direction change edge 10, the taking out direction of the binding tape 5 is changed vertically at right angle. That is, the binding tape taken out from the wound tape 1 disposed horizontally is guided by the rollers 8 and 9 while keeping vertical in the width direction of the tape, then is changed to a vertical direction in its taking-out direction by the direction change edge 10 while being twisted, then the binding tape 5 becomes horizontal on the table 3 to stand by for binding an article. Thereby, the wound tape 1 can be disposed horizontal, and further thus disposing horizontally, between the tape taking-out section 7 and the cutting section 4 the wound tape 1 can be disposed, and the taken out binding tape 5 can be further taken out toward the cutting section 4 located opposite to the taking-out section 7, which can cause the whole structure to be compact.

Next, an explanation about the cutting section 4 shown in FIG. 9 is as follows. The cutting section 4 is provided with a tape guide member 21, on which a pin 20 for retaining the taken out binding tape 5 is provided. And, on this tape guide member 21 a neck portion having an opening width W1 is formed to prevent a finger from touching the pin 20 directly and to guide the binding tape 5 in such a manner as an end of the binding tape 5 is picked by the pin 20 for being retained there.

Further, the front side of the supporting pole 17 (FIG. 1) a clasp 23 is fixed, in which a cutter 22 is coupled and fixed in a screw hole 24 provided on the clasp 23 removably by a screw. Next, an explanation of FIGS. 14 and 15 is as follows. An adhesion preventing plate 26 is planted vertically at a position spaced from the tape taking-out guide member 11' on an end of the base plate 14 located at the side of the tape taking-out member 11'. For example, when working on binding while fixing the base plate 14 around a thigh, the binding tape 5 taken out on the tape taking-out guide member 11' is prevented from being stuck to cloth to improve working ability. 27 is a hook for fixing the base plate 14 on the waist of a worker by hooking it on a belt of the worker, which is adapted to be able to change the position to mount the hook like shown as a hook 27' depending on the posture or physical dimension of the worker. Further, when fixing the base plate 14 on a thigh, the hook is mounted on the base plate 14, as shown in a hook 27", and this hook 27" is hung on a belt borne around the waist. What are shown in FIGS. 14 and 15 show an example of the type, in which the tape reel 2 is disposed at the center of the base plate 14, however, it can apply to the type, in which the tape reel 2 is juxtaposed to the base plate 14 as shown in FIGS. 1, 2 and 4. About the other portions, since those are identical with ones shown in FIGS. 1–7, further explanations are omitted by using identical signs to the identical portions.

Next, based on FIGS. 11–13, how to take out the binding tape 5 is explained. The simple binding device shown in FIGS. 1–13 is what is shown in FIG. 6. First, the binding tape 5*a* (FIG. 12) taken out from the wound tape 1 following an arrow (A) is next hooked around the roller 9 following an arrow (B), then is wound around the wound tape 1 following an arrow (C), then further by being taken out the binding tape 5*b* (FIG. 12) is hooked around the roller 9 in such a manner as it overlaps on the previously taken out binding tape 5*a* as an arrow (D), then the binding tape 5*b* is further taken out along the guide roller 9 and changed its direction from horizontal to vertical by using the direction changing edge 10 as shown in arrows (E) and (F) and further the tape is taken out using a corner edge of the tape taking-out guide member 11 from vertical to horizontal shown in arrows (G), (H).

By thus taking out the binding tape 5, since the binding tape 5*b* is taken out while being adhered to a portion of the wound tape 1 and to a portion of the previously taken out tape 5*a*, the adhered portion of the binding tape 5*b* presents a resistance against the taking-out force of the binding tape 5*b*, even merely with one guide roller 9 the binding tape 5*b* is not taken out excessively and has no tendency of being loosened. Further, to increase the resistance force the binding tape 5*b* may be taken out by winding around the wound tape 1 once more following arrows (B) and (C) as a binding tape 5*c*. FIGS. 4 and 6 show how to take out the binding tape 5. In what is shown in FIG. 2 also, the binding tape 5 can be identically taken out like the above.

Figure 10B:
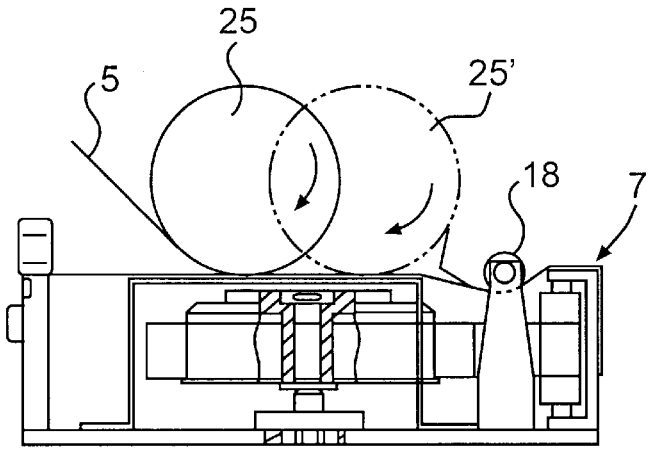
Figure 10C:
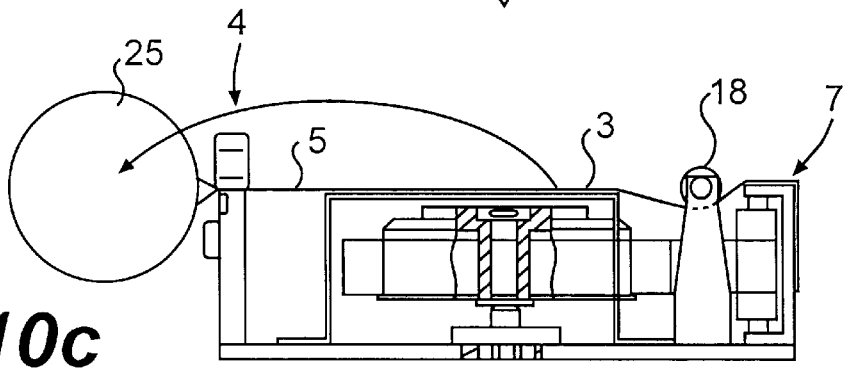

Next, an explanation of how to bind an article to be bound is made based on FIG. 10. The simple binding device illustrated in FIGS. 10*a, b* and *c* is what is shown in FIG. 4. First, in a state where the binding tape 5 is extended on the table 3 while the end thereof being retained on the pin 20 provided at the cutting section 4, an article 25 to be bound is put on the binding tape 5 extended on the table 3 as depicted in FIG. 10*a*. Next, as shown in FIG. 10*b*, while picking up the end of the binding tape 5 and rolling the article 25 to be bound on the table 3 toward a direction 25', the binding tape 5 is wound around the article 25 to be bound. In this winding process; of the binding tape 5, since the binding tape 5 has the resistance force against a taking-out direction, the article 25 to be bound is bound tightly by the binding tape 5. Thus, after binding as shown in FIG. 10*c*, the article 25 around which the binding tape 5 is wound is displaced toward the cutting section 4 from the table 3 while taking out the binding tape 5 following an arrow, and the binding tape 5 is retained on the pin 20 by being picked, then it is cut with the cutting blade 22. Thereby, the binding process of the article 25 to be bound finishes and the binding tape 5 returns to the initial state where the binding tape is taken out as depicted in FIG. 10 *a* to stand by for next binding process. This manner of binding an article can be carried out identically in the simple binding device shown in FIGS. 2 and 6.

Next, the function of the present invention is explained. In FIGS. 2, 4 and 6, by disposing the tape reel 2 for holding a wound tape 1 horizontal with and between the binding tape taking-out section 7 and the cutting section 4, it is possible to take out the binding tape 5 from the binding tape taking-out section 7 and tension it toward the cutting section 4 while passing it on the wound tape 1 disposed horizontally. Thus, by disposing the tape reel 2 itself or the table 3 between the binding tape taking-out section 7 and the cutting section 4, a binding device can be formed, and it is possible to shorten a total length L3 and lower a total height of the simple binding device.

Figure 1:
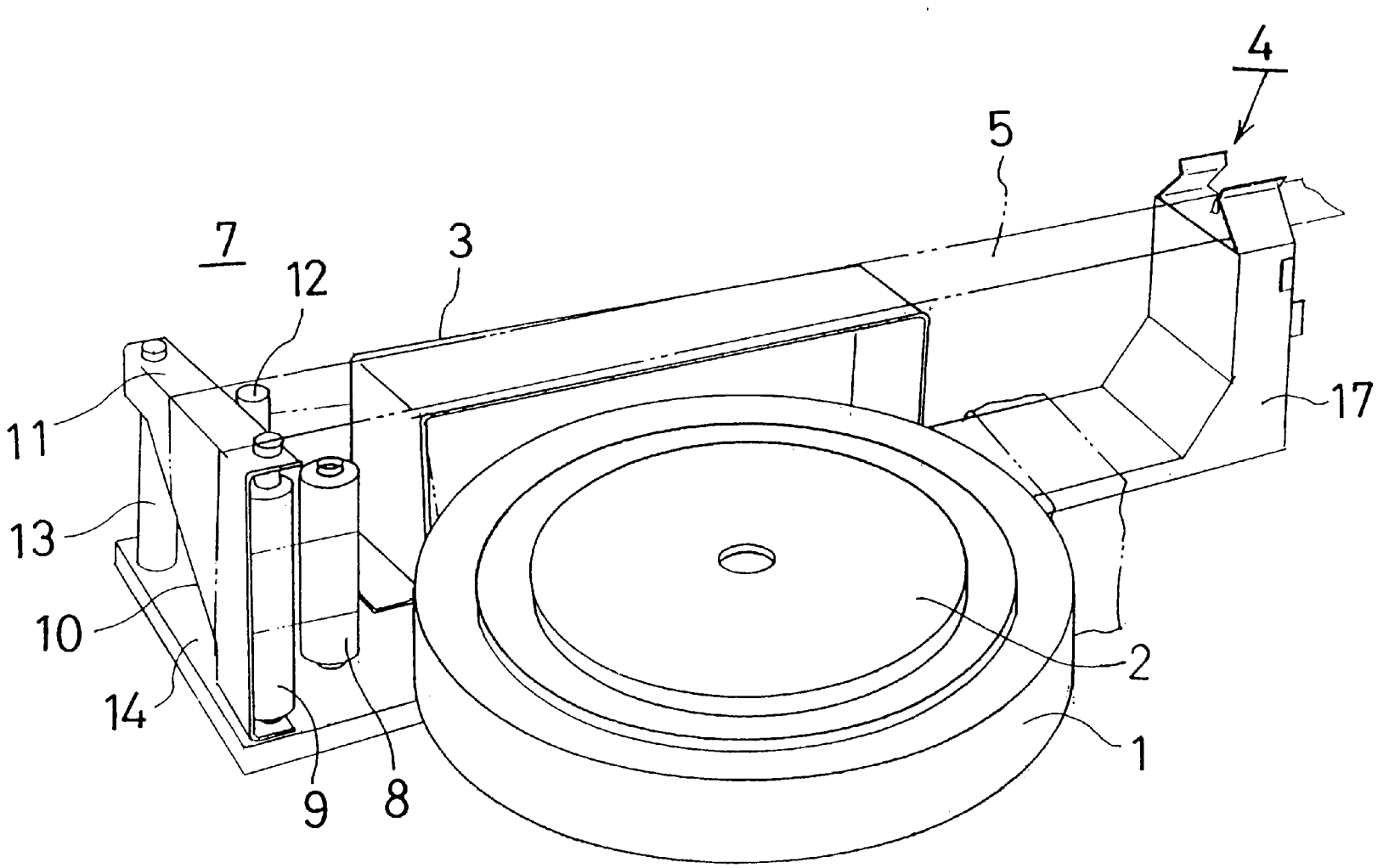
FIG. 1 is a perspective view of an embodiment of the present invention.

Further, as shown in FIG. 6, by disposing the tape reel 2 just under the binding tape 5 taken out and tensioned between the binding tape taking-out section 7 and the cutting section 4 in such a manner as it can be used as a table for putting an article to be bound, the table 3 as shown in FIG. 1 becomes unnecessary, which causes the device to reduce the total weight and to make the center of gravity located approximately at the center of the simple binding device.

Further, as shown in FIGS. 2 and 4, by disposing the table 3 for putting articles to be bound just under the binding tape 5 taken out from the tape taking-out section 7 and the tape reel 2 beside the table 3, regardless of the dimension (diameter) of the wound tape 1 the total length L3 of the simple binding device can be further shortened.

And, at the tape taking-out section 7, as shown in FIG. 1, the tape guide bar 12, the guide rollers 8 and 9, or as shown in FIGS. 4 and 6, the guide roller 9 are provided, and therefrom a resistance against the taking-out force is generated on the binding tape 5 taken out, so that an excessive taking-out and an loosening of the binding tape 5 is prevented, and at the time of binding shown at (b) in FIG. 10, the article 25 to be bound can be bound under an appropriate tension. Further, thus by giving a resistance to the taken-out force, the tape reel 2 itself can avoid from employing a mechanism such as a friction clutch to reduce the total weight.

Further, as shown in FIGS. 14 and 15, by providing the adhesion preventing plate 26 at the end of the base plate 14 and at the position spaced at a given spacing from the binding tape taking-out position 11', it can prevent a clothing of any worker from adhering thereto during working. And by providing the hook 27 on the base plate 14 removably, it is possible to prevent the base plate 14 from slipping off the body.

As explained above, many effects are recognized from the detailed explanation of the present invention based on each claim.

In accordance with the present invention recognized based on claim 1, since a tape reel for keeping a wound tape is disposed horizontally with and between a tape taking-out section and a cutting section to shorten the total length and lower the total height of a simple binding device, it is possible to make the device small sized and light-weighted and to make it easier in bearing it on a human body.

Next, in accordance with the present invention recognized based on claim 2, since a tape reel is disposed just under the binding tape 5 taken out from a binding tape taking-out section toward a cutting section, a table for putting an article to be bound becomes unnecessary, so that the weight of a simple binding device can be reduced.

Next, in accordance with the present invention recognized based on claim 3, since a table for putting an article to be bound is disposed just under the binding tape taken out and tensioned from a binding tape taking-out section toward a cutting section, and beside the table a tape reel is disposed, without being limited by this wound tape, the simple binding device can be further small-sized and light-weighted and to make further easier to bear it on a human body.

Next, in accordance with the present invention based on claim 4, since, at a portion of tape taking-out section, guide rollers for giving a resistance against a taking-out force to the binding tape to be taken-out are provided, an excessive taking-out or an loosening of the binding tape is avoided and an appropriate tension of the binding tape can be obtained to increase the binding ability.

Next, in accordance with claim 5, since, on one end of the base plate 14 at the side of the tape taking-out section, an adhesion preventing plate is provided at a position spaced from the tape taking-out section at a given space, and the binding tape taken out from the tape taking-out section is prevented from being stick to a clothing of a worker, the operation and handling ability are increased.

Next, in accordance with the present invention recognized based on claim 6, since a hook is provided on a base plate removably and prevented from being slipped off the body of a worker, the operation and handling ability are increased.

What is claimed is:

1. A simple binding device wherein a binding tape is taken out and after binding an article to be bound an excessive binding tape is cut by a cutter, the simple binding device is characterized in that a tape reel for retaining a wound tape is disposed between a tape taking-out section and a cutting section horizontally with each other and wherein the device is characterized in that the tape reel is provided as a table for putting an article to be bound just under the binding tape taken out from the tape taking-out section and tensioned toward the cutting section.

2. A simple binding device according to claim 1, wherein the device is characterized in that guide rollers for giving a resistance to the binding tape in such a manner as a tension is effected on the binding tape.

3. A simple binding device according to claim 1, wherein the device is characterized in that an adhesion preventing plate is provided on the end of a base plate in a position spaced from the tape taking-out section at a given spacing.

4. A simple binding device according to claim 1, wherein the device is characterized in that removable hook is provided on a base plate.

* * * * *

UNITED STATES PATENT AND TRADEMARK OFFICE

CERTIFICATE OF CORRECTION

PATENT NO. : 5,992,490
DATED : Nov. 30, 1999
INVENTOR(S) : Toshimasa KAKITA et al.

It is certified that error appears in the above-identified patent and that said Letters Patent is hereby corrected as shown below:

Claim 4, line 2, replace "removable",
with --a removable--

Signed and Sealed this

Sixth Day of March, 2001

*Attest:*

Nicholas P. Godici

NICHOLAS P. GODICI

*Attesting Officer*

*Acting Director of the United States Patent and Trademark Office*